US008240633B2

(12) United States Patent
Penza

(10) Patent No.: US 8,240,633 B2
(45) Date of Patent: Aug. 14, 2012

(54) CONCRETE FORMING APPARATUS FOR USE IN FORMING CONCRETE SUPPORT COLUMNS

(76) Inventor: Blayde Penza, Sun Valley, CA (US)

( * ) Notice: Subject to any disclaimer, the term of this patent is extended or adjusted under 35 U.S.C. 154(b) by 515 days.

(21) Appl. No.: 12/454,545

(22) Filed: May 19, 2009

(65) Prior Publication Data

US 2009/0232606 A1 Sep. 17, 2009

Related U.S. Application Data

(63) Continuation-in-part of application No. 11/977,255, filed on Oct. 25, 2007, now abandoned.

(51) Int. Cl.
*E04G 13/02* (2006.01)

(52) U.S. Cl. ..... 249/48

(58) Field of Classification Search ..... 249/48, 249/49, 50, 51; 264/32
See application file for complete search history.

(56) References Cited

U.S. PATENT DOCUMENTS

| | | | | | |
|---|---|---|---|---|---|
| 1,060,304 | A | | 4/1913 | Woodley | |
| 1,299,739 | A | | 4/1919 | Landwehr | |
| 1,398,412 | A | * | 11/1921 | Barkschat | 249/48 |
| 1,627,754 | A | * | 5/1927 | Townsend | 249/51 |
| 1,837,092 | A | * | 12/1931 | Almquist | 249/173 |
| 1,918,333 | A | * | 7/1933 | Hallquist | 249/48 |
| 2,831,231 | A | * | 4/1958 | Toensing | 249/48 |
| 3,700,008 | A | * | 10/1972 | Hackman | 138/99 |
| 3,785,607 | A | * | 1/1974 | Worker et al. | 249/48 |
| 3,844,527 | A | | 10/1974 | Scott | |
| 3,956,437 | A | | 5/1976 | Ellis | |
| 3,990,672 | A | * | 11/1976 | Buchanan | 249/48 |
| 3,996,757 | A | * | 12/1976 | Liddell | 405/216 |
| 4,047,356 | A | * | 9/1977 | DePirro | 249/48 |
| 4,767,095 | A | | 8/1988 | Fitzgerald et al. | |
| 4,887,789 | A | * | 12/1989 | Harris et al. | 249/48 |
| 5,079,805 | A | * | 1/1992 | Mlachnik | 24/20 LS |
| 5,102,265 | A | * | 4/1992 | Dokmo et al. | 405/216 |
| 5,178,887 | A | | 1/1993 | O'Conner et al. | |
| 5,327,694 | A | | 7/1994 | Gamel et al. | |
| 5,376,316 | A | | 12/1994 | Weekers | |
| 5,816,746 | A | * | 10/1998 | Blair | 405/216 |
| 6,220,564 | B1 | | 4/2001 | Costello | |
| 6,808,667 | B2 | | 10/2004 | Nasvik et al. | |
| 6,997,427 | B2 | | 2/2006 | Manthei | |
| 2009/0084930 | A1 | * | 4/2009 | Ball et al. | 249/48 |

* cited by examiner

*Primary Examiner* — Michael Safavi
(74) *Attorney, Agent, or Firm* — James E. Brunton

(57) ABSTRACT

A lightweight forming system and the method of using same that can be used to construct concrete columns of various external shapes and sizes. The system includes a reusable, flexible securement jacket that can be wrapped around a concrete receiving component having a concrete receiving chamber into which the concrete is poured. Load is exerted on the concrete receiving component in a novel manner through the use of elongated load tubes that are affixed to the spaced apart edges of the securement jacket. A plurality of draw-latches of novel construction are affixed to the load tubes at vertically spaced apart locations and when closed by the workman function to forcefully pull the load tubes together to positively pre-load the concrete receiving component prior to pouring concrete. The securement jacket of the system can be quickly and easily removed as soon as the concrete has sufficiently cured and can then be immediately reused to pour another column. Following use, the securement jacket can be rolled into a tight bundle for transport and storage.

10 Claims, 10 Drawing Sheets

68
72
77
70a
74
70

68
72
77
75
70a
70
66
75
64

79
68
72
77
75
70a
70
66
74
75

68
72
77
75
75
70
66
74

Fig. 13
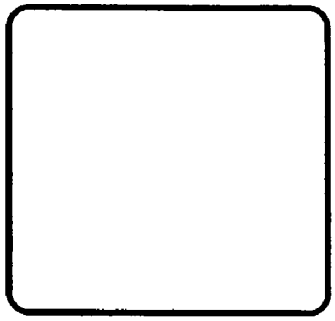
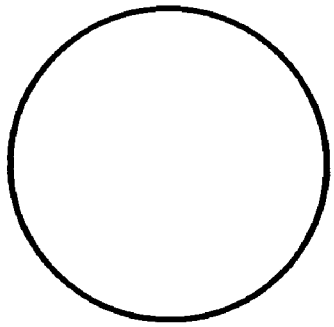
Fig. 14
Fig. 15
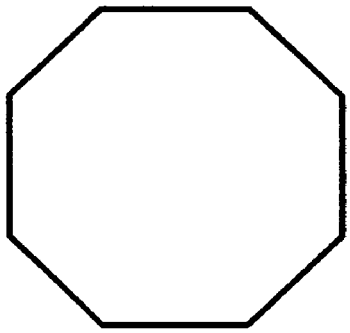

CONCRETE FORMING APPARATUS FOR USE IN FORMING CONCRETE SUPPORT COLUMNS

CROSS-REFERENCE TO RELATED APPLICATIONS

This is a Continuation In Part of U.S. application Ser. No. 11/977,255 filed Oct. 25, 2007 now abandoned.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

The present invention relates generally to a concrete forming apparatus and the method of using the same. More particularly, the invention concerns a concrete forming apparatus that is especially well suited for use in forming concrete support columns.

2. Description of Related Art Including Information Disclosed Under 37 CFR 1.97 and 1.98

A common practice in the construction industry is to use specially constructed wooden forms, or alternatively, elongate paper fiber tubes to form concrete columns. The use of wooden forms is generally quite time consuming and cost ineffective. While the use of paper fiber tubes is more efficient than the use of wooden forms, these paper fiber tubes are typically very bulky and are quite cumbersome to handle and transport. Additionally, the tubes are quite expensive and can be used only once and then scrapped. Once the tube is in place and properly anchored, concrete is poured into the interior of the tube and allowed to harden so as to form a column. After the concrete has hardened, the tube is stripped away from the concrete column and discarded.

Obviously, the use of the paper fiber tubes produces a generally cylindrically shaped column with a relatively smooth outer surface. In order to use the conventional paper fiber tubes to produce other than a cylindrically shaped column, the Sonoco Company of Hartsville, S.C. has developed a concrete form that comprises a paper fiber tube having an elongate, square fiberboard insert that is locked in place with polystyrene. The use of these modified paper fiber tubes enables the formation of substantially rectangular-shaped columns.

The thrust of the present invention is to provide a novel, lightweight, forming system that includes a reusable, flexible jacket that can be secured about a selected Styrofoam shape into which the concrete is poured. By using Styrofoam shapes of various configurations, concrete columns of selected external shapes can readily be formed.

BRIEF SUMMARY OF THE INVENTION

It is an object of the present invention to provide a novel, lightweight forming system and the method of using same that can be used to construct concrete columns of various external shapes.

Another object of the invention is to provide a system of the aforementioned character which comprises a reusable, flexible securement jacket that can be wrapped around a Styrofoam shape into which the concrete is poured.

Another object of the invention is to provide a system as described in the preceding paragraph in which the load exerted on the Styrofoam shape by the poured concrete is distributed evenly throughout the entire surface of the securement jacket material.

More particularly, the load is carried solely by the tensile strength of the securement jacket material through the use of elongated load tubes that are affixed to the spaced apart edges of the securement jacket. A plurality of draw-latches of novel construction are affixed to the load tubes at vertically spaced apart locations and when closed by the workman function to forcefully pull the load tubes together to positively pre-load the Styrofoam shape prior to pouring concrete. Additionally, the vertical load tubes function to lift and position the securement jacket material smoothly and evenly about the Styrofoam shape until the draw-latches can be engaged.

With the forgoing in mind, it is a specific object of the invention to provide a method and apparatus as described in the preceding paragraphs, which unlike certain of the prior art structures, does not use bands, straps, hoops, ribs, walers or strong backs as load bearing members when pouring the concrete column.

Another object of the invention is to provide a system of a character described that comprises a one piece assembly with no loose parts.

Another object of the invention is to provide a system as described in the preceding paragraphs in which the securement jacket is provided in various lengths to accommodate various column heights.

Another object of the invention is to provide a system of the class described which requires no tools to accomplish the erection of the system.

Another object of the invention is to provide a method and apparatus of the character described in the preceding paragraphs in which the securement jacket of the apparatus can be quickly and easily removed as soon as the concrete has sufficiently cured and can be immediately reused to pour another column.

Another object of the invention is to provide a method and apparatus as described in which columns of any height can be formed by staggering the joints of the Styrofoam shape relative to the joints of the securement jacket.

Another object of the invention is to provide an apparatus of the class described that is easy-to-use, easy to store and easy to transport. More particularly, it is an object of the invention to provide a securement jacket of the character described that can be rolled into a tight bundle for transport and storage.

Another object of the invention is to provide a novel, lightweight forming system that is particularly useful in replacing existing wooden columns that are used to support an overhead structure with concrete columns of selected exterior design.

Another object of the invention is to provide a forming system and a method of using the system as described in the preceding paragraph which can be used to replace existing columns supporting an overhead structure without the necessity of removing, or damaging the existing overhead structure.

BRIEF DESCRIPTION OF SEVERAL VIEWS OF THE DRAWINGS

FIG. 13 is a cross-sectional view of an alternate form of column shape that can be produced in accordance with an alternate form of the method of the invention.

FIG. 14 is a cross-sectional view of still another form of column shape that can be produced in accordance with an alternate form of the method of the invention.

FIG. 15 is a cross-sectional view of still another form of column shape that can be produced in accordance with an alternate form of the method of the invention.

DETAILED DESCRIPTION OF THE INVENTION

Figure 1:
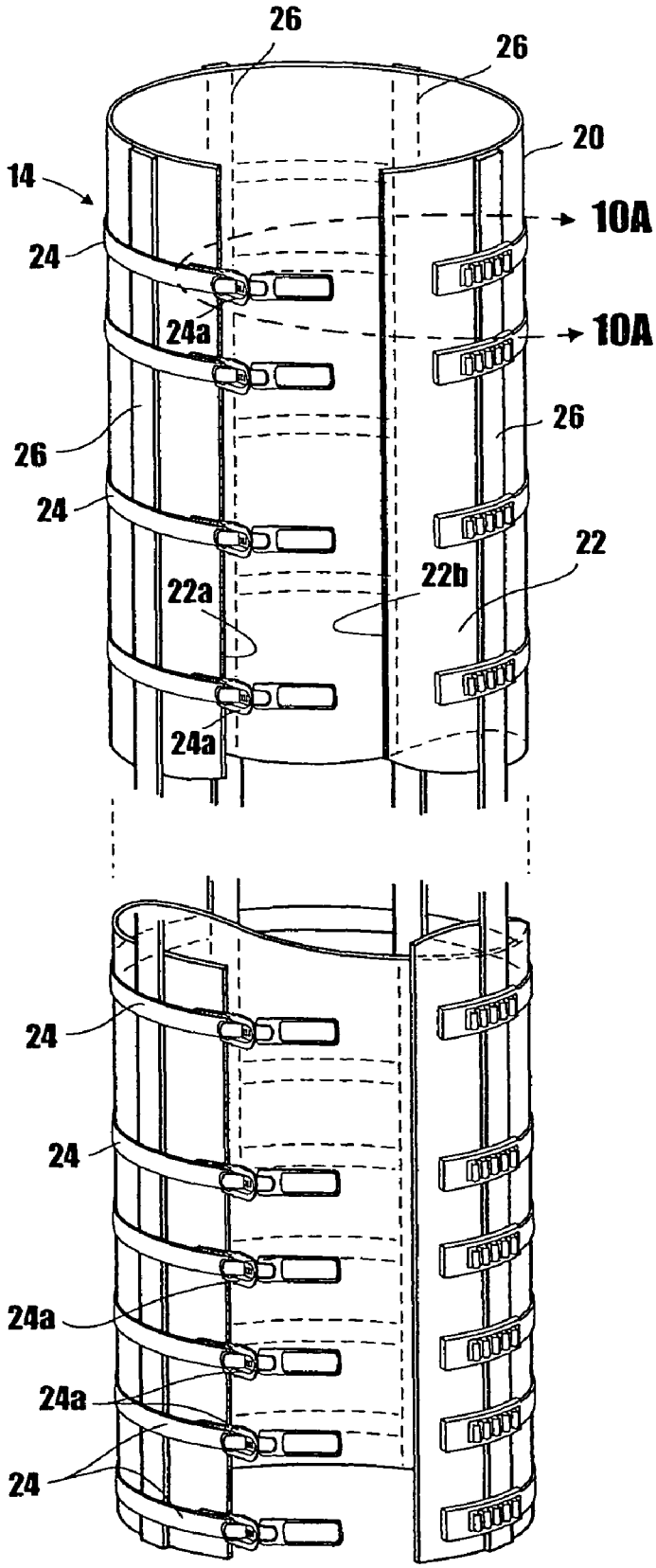
FIG. 1 is a generally perspective, foreshortened view of one form of the securement component of the concrete forming system of the invention.
Figure 2:
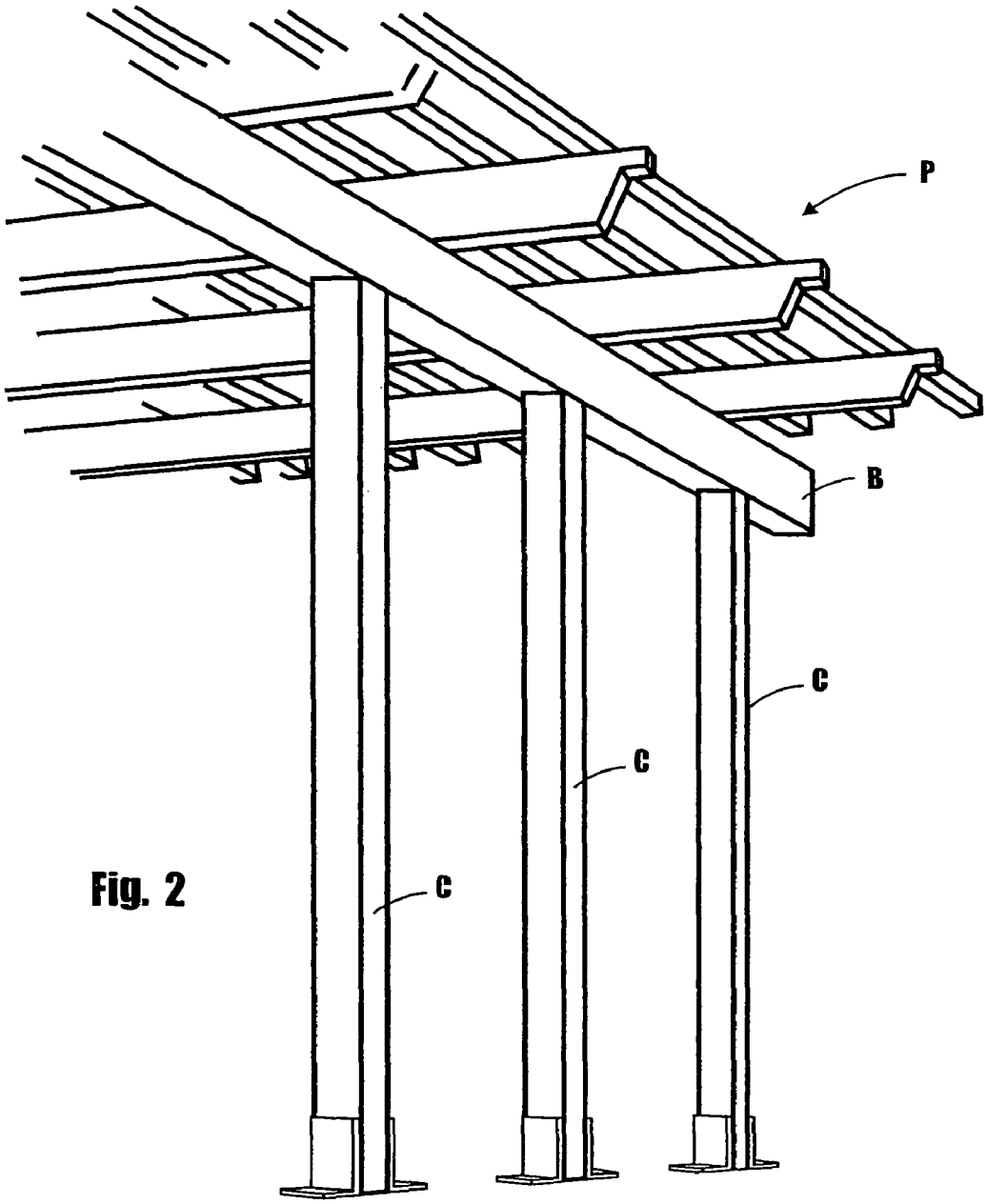
FIG. 2 is a generally perspective view of a prior art overhead structure embodying a plurality of wooden vertical support members the character of which are replaced by concrete columns formed in accordance with one form of the method of the present invention.
Figure 6:
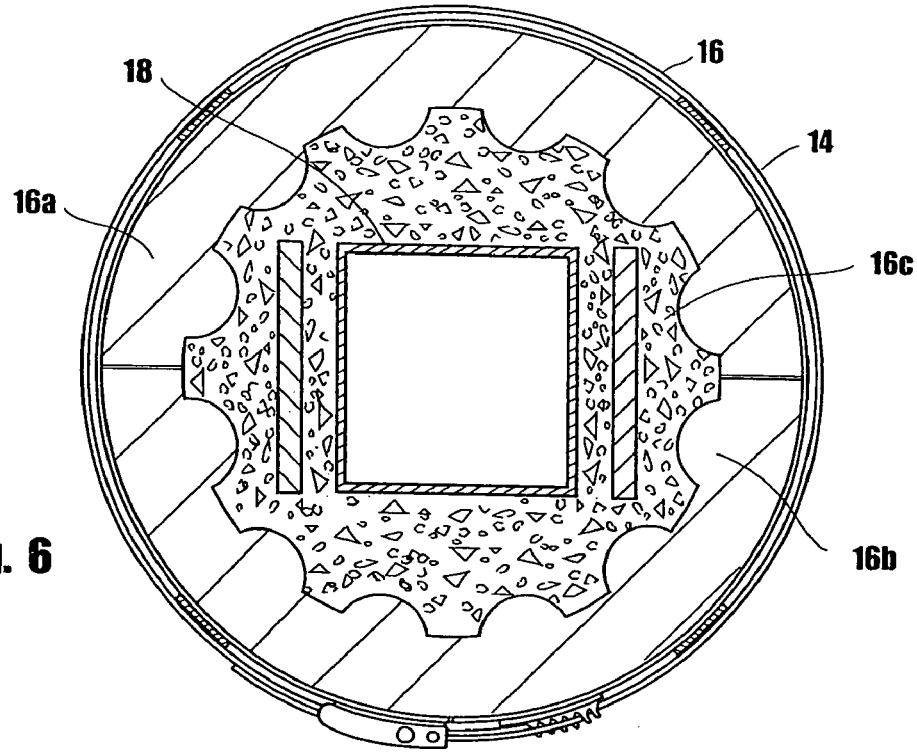
FIG. 6 is an enlarged cross-sectional view taken along lines 6-6 of FIG. 5.
Figure 7:
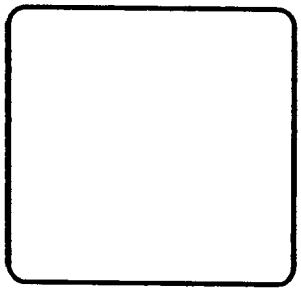
FIG. 7 is a cross-sectional view of an alternate form of column shape that can be produced in accordance with the method of the present invention.
Figure 8:
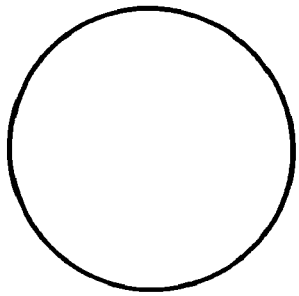
FIG. 8 is a cross-sectional view of still another form of column shape that can be produced in accordance with the method of the present invention.
Figure 9:
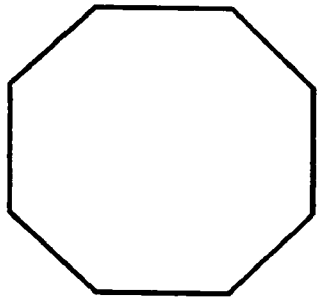
FIG. 9 is a cross-sectional view of yet another form of column shape that can be produced in accordance with the method of the present invention.

Referring to the drawings and particularly to FIGS. 1, 3, 4 and 5, the various components of one form of the apparatus of the invention for constructing a concrete column are there shown. One of the most important and unique components of the apparatus is the novel securement component 14 the character of which it is shown in FIG. 1 of the drawings. The details of the construction and operation of this important securement component will presently be described. FIG. 6 of the drawings shows the securement component 14 of the concrete forming system of the invention encircling the equally important, rigid elongate member 16 of the invention. Member 16 has a concrete receiving chamber 16*a* that is here shown as being generally fluted in cross-section and within which an elongate metal reinforcing member 18 is centrally disposed. It is to be understood that the concrete receiving chamber can also be generally rectangular in cross-section (FIG. 7), can be generally circular in cross-section (FIG. 8) and can be generally octagonal in cross-section (FIG. 9). It is apparent that the shape of the concrete receiving chamber dictates the shape of the outer surface of the concrete column that is to be formed in accordance with the method of the invention.

As best seen in FIG. 1 of the drawings, securement component 14 here comprises a reusable, flexible securement jacket 20 that includes a body portion 22 having lateral edges 22*a* and 22*b*. Securement jacket 20 also includes connector means for interconnecting the lateral edges to secure the securement jacket in position about the rigid elongate member 16 in the manner shown in FIG. 6. As best seen in FIG. 1, the connector means here comprises a plurality of longitudinally spaced-apart connector straps 24 to which a plurality of conventional adjustable latches 24*a* are connected (see also FIGS. 10A, 10B and 10C). In the present form of the invention, the connector means also comprise a plurality of conventional latch engaging elements 24*b* that are also carried by the spaced-apart connector straps 24 (see FIGS. 5, 10A, 10B and 10C). The connector straps, the adjustable latches and the latch engaging elements are constructed and arranged so that the adjustable latches 24*a* are positioned proximate the lateral edge 22*a* of the flexible body portion 22 and the latch engaging elements 24*b* are positioned proximate the lateral edge 22*b* of the flexible body portion. Adjustable latches 24*a* as well as latch engaging elements 24*b* are readily commercially available from hardware stores and building supply outlets. As also shown in FIG. 1, reusable, flexible securement jacket 20 further includes plurality of circumferentially spaced-apart, generally longitudinally extending steel reinforcing straps 26 that are connected to body portion 22 in the manner shown in FIG. 1.

Securement jacket 20 can be constructed from various durable materials, such as canvas and like materials. Rigid elongate member 16, which comprises first and second cooperating portions 16*a* and 16*b* (See FIG. 6), can also be constructed from various materials, but preferably is constructed from a lightweight foam material such as Styrofoam.

Considering now one form of the method of the invention for constructing a vertically extending concrete column. In the simplest form of the method of the invention, the two halves 16*a* and 16*b* of the rigid elongate member 16 are joined together and disposed in a generally vertical orientation. This done, the securement component 14 is wrapped around the elongate member in the manner illustrated in FIG. 6. The assemblage thus formed takes the place of the elongate paper fiber tubes typically used in prior art concrete column forming methods.

Figure 10A:
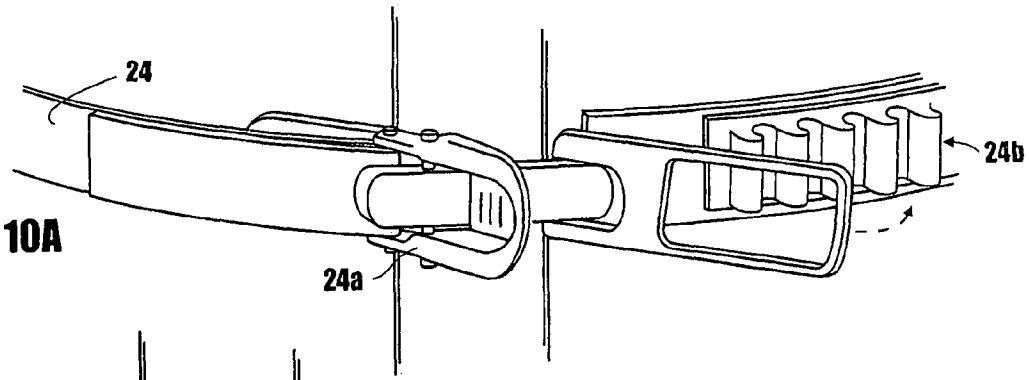
FIG. 10A is a greatly enlarged, generally perspective view of the area designated as 10A-10A in FIG. 1.
Figure 10B:
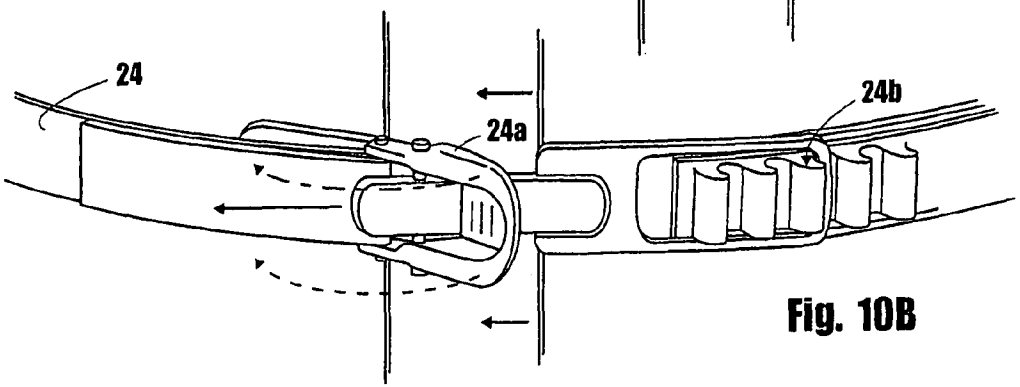
FIG. 10B is a view similar to FIG. 10A but showing the next step in the operation of one of the adjustable latches of the invention.
Figure 10C:
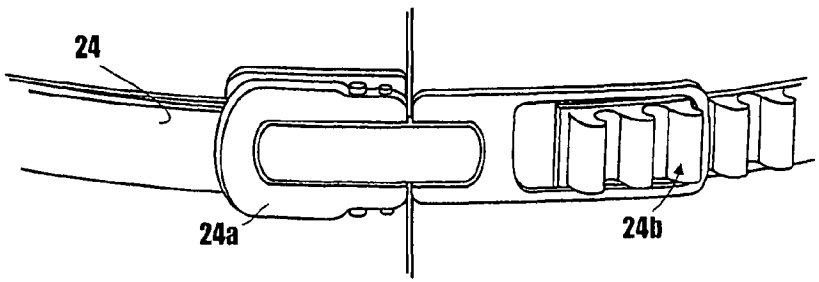
FIG. 10C is a view similar to FIG. 10B but showing the final step in the operation of the adjustable latch.

With the securement component in position around the Styrofoam elongate member 16 in a manner so as to substantially prevent expansion of the rigid elongate member, the latches 24*a* are interconnected with the latch engaging elements 24*b* so as to secure together the lateral edges of the securement jacket in the manner illustrated in FIGS. 10A, 10B and 10C of the drawings. The latches and the latch engaging elements are constructed and arranged so that they effectively function to bring the securement jacket 20 into secure pressural engagement with the elongate member 16. Next, the concrete is poured into the concrete receiving chamber 16*c* (FIG. 6) formed interiorly of the elongate member 16, and the flexible securement jacket is maintained in position about the rigid elongate member for a period of time sufficient to allow the concrete to set-up to form a hardened concrete column.

Once the concrete has set up, the latches 24*a* are manipulated so that the securement jacket can be removed from its position about the elongate member 16. Once removed, the securement jacket can be rolled into a compact roll for transport and storage pending its next use. With the securement jacket removed from about the elongate member 16, the two halves of the elongate member can be separated from the concrete column and appropriately stored for subsequent use.

Another form of the method of the present invention is illustrated in FIGS. 2, 3, 4 and 5 of the drawings. This method involves the replacement with concrete columns of defective existing wooden columns, such as the columns "C" shown in FIG. 2 of the drawings, that are used to support an overhead beam "B" of a structure such as the patio structure "P".

Figure 3:
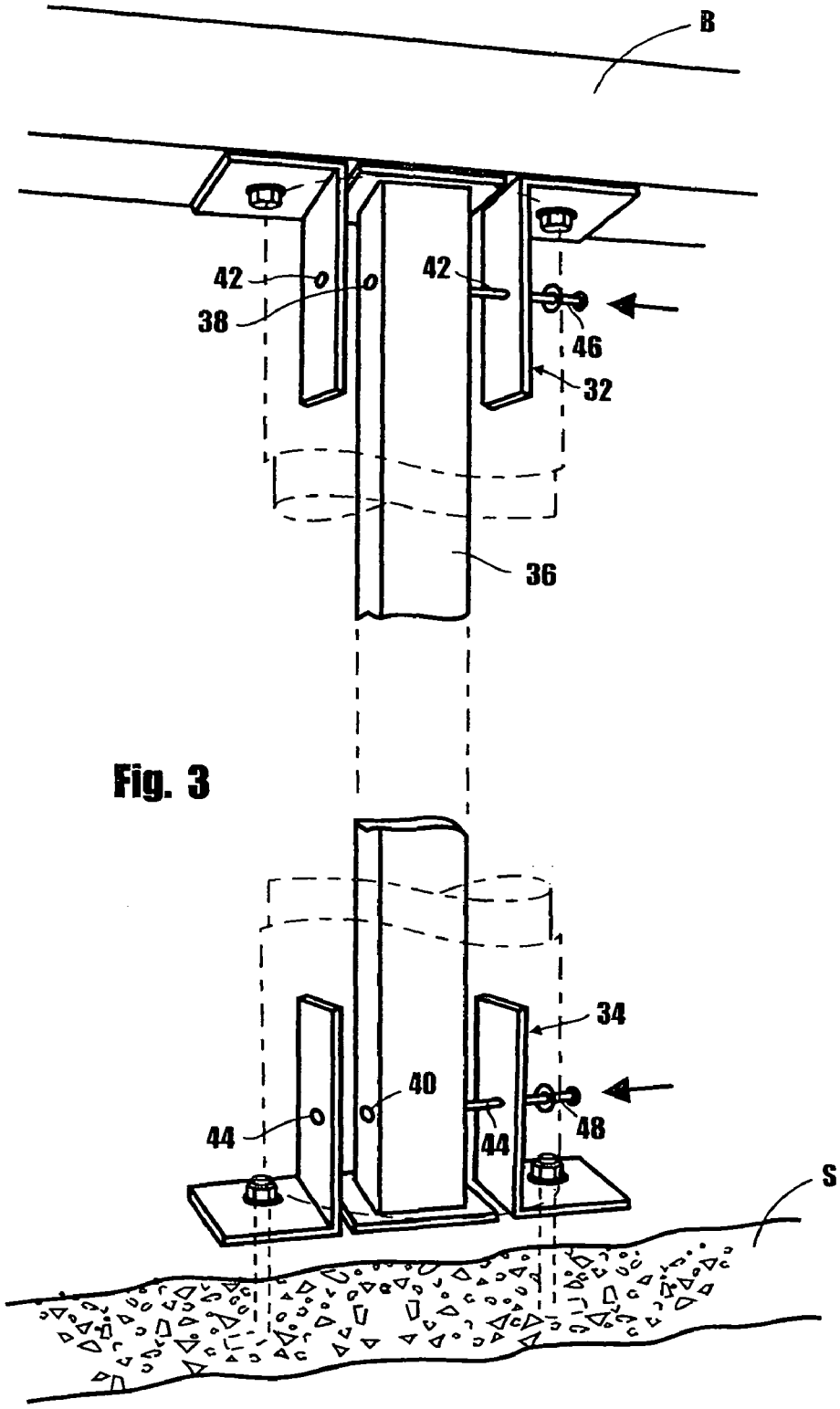
FIG. 3 is a generally perspective, foreshortened view illustrating one step of one form of the method of the invention for replacing rotted wooden vertical support members with concrete columns using the concrete forming system of the present invention.

Following removal of one of the effective existing wooden columns, the first step in this alternate method of the invention is to affix to the overhead beam a first pair of spaced-apart "L" brackets 32 (see FIG. 3). This done a second pair of spaced-apart "L" brackets 34 are affixed to the concrete slab "S" at a location directly beneath the spaced-apart brackets 32. Next, a metal reinforcing member 36 is positioned within the brackets 32 and 34 and beneath the beam "B" in the manner illustrated in FIG. 3 of the drawings. As indicated in FIG. 3, metal reinforcing member 36, is provided with upper and lower through bores 38 and 40 respectively that are located so as to align with bolt receiving apertures 42 and 44 respectively formed in brackets 32 and 34. An upper bolt 46, which is receivable through apertures 42 formed in upper brackets 32 and through upper bore 38 formed in reinforcing member 36, functions to secure the reinforcing member to the upper brackets. In similar fashion, a lower bolt 48, which is receivable through apertures 44 formed in lower brackets 34 and through lower bore 40 formed in reinforcing member 36, functions to secure the reinforcing member to the lower brackets.

Figure 4:
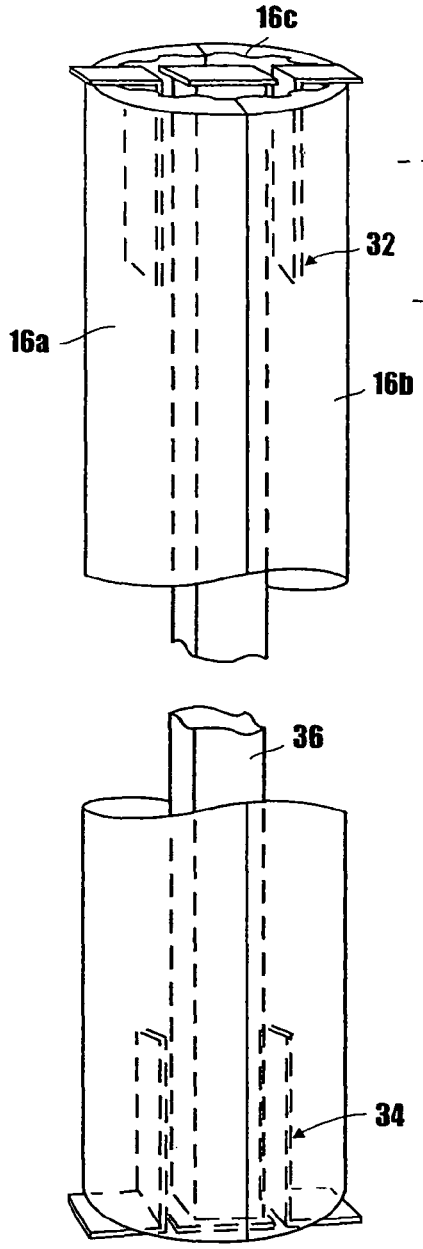
FIG. 4 is a generally perspective, foreshortened view illustrating the next step of one form of the method of the invention for replacing rotted wooden vertical support members wherein the Styrofoam insert component of the apparatus of the invention is positioned about the structure illustrated in FIG. 3.
Figure 5:
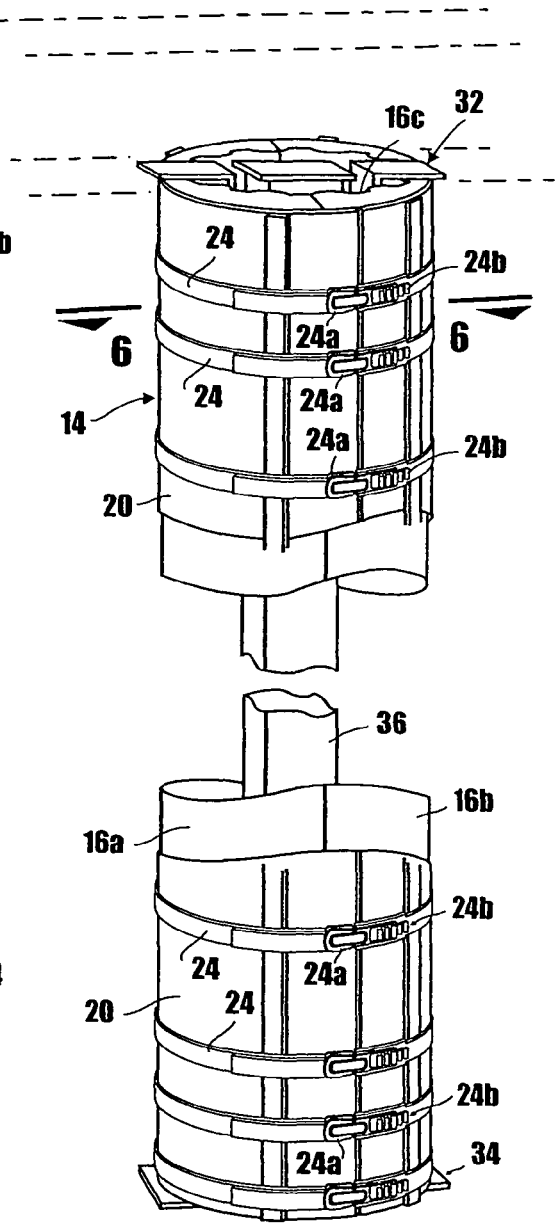
FIG. 5 is a generally perspective, foreshortened view illustrating the next sequential step of one form of the method of the invention for replacing rotted wooden vertical support members wherein the securement component of the apparatus of the invention is positioned about the structure illustrated in FIG. 4.

Once the bolts 46 and 48 have been appropriately secured to brackets 32 and 34, the next step in this latest form of the method of the invention is to place the two halves 16*a* hand 16*b* of the Styrofoam support member 16 about the assemblage shown in FIG. 3 and comprising the reinforcing member 36 and the brackets 32 and 34 (see FIG. 4). This done, the securement component 14 is wrapped around the elongate member in the manner illustrated in FIG. 5. As before, the assemblage thus formed takes the place of the elongate paper fiber tubes typically used in prior art concrete column forming methods.

With the securement component in the circumscribing position around the Styrofoam elongate member 16 so as to substantially prevent expansion of the rigid elongate member, the latches 24*a* are interconnected with the latch engaging elements 24*b* in the manner illustrated in FIGS. 10A, 10B and 10C of the drawings so that the securement jacket 20 is brought into secure pressural engagement with the elongate member 16. Next, the concrete can be poured into the concrete receiving chamber 16*c* (FIG. 6) formed interiorly of the elongate member 16 and allowed to set up in a normal fashion. If necessary, a metal guide shoot (not shown) can be used to guide the concrete into the concrete receiving chamber 16*c*.

Once the concrete has set up, the latches 24*a* are manipulated so that the securement jacket can be removed from its position about the elongate member 16. Once removed, the securement jacket can be rolled into a compact roll for transport and storage pending its next use. With the securement jacket removed from about the elongate member 16, the two halves of the elongate member can be separated from the concrete column and appropriately stored for subsequent use.

Figure 11:
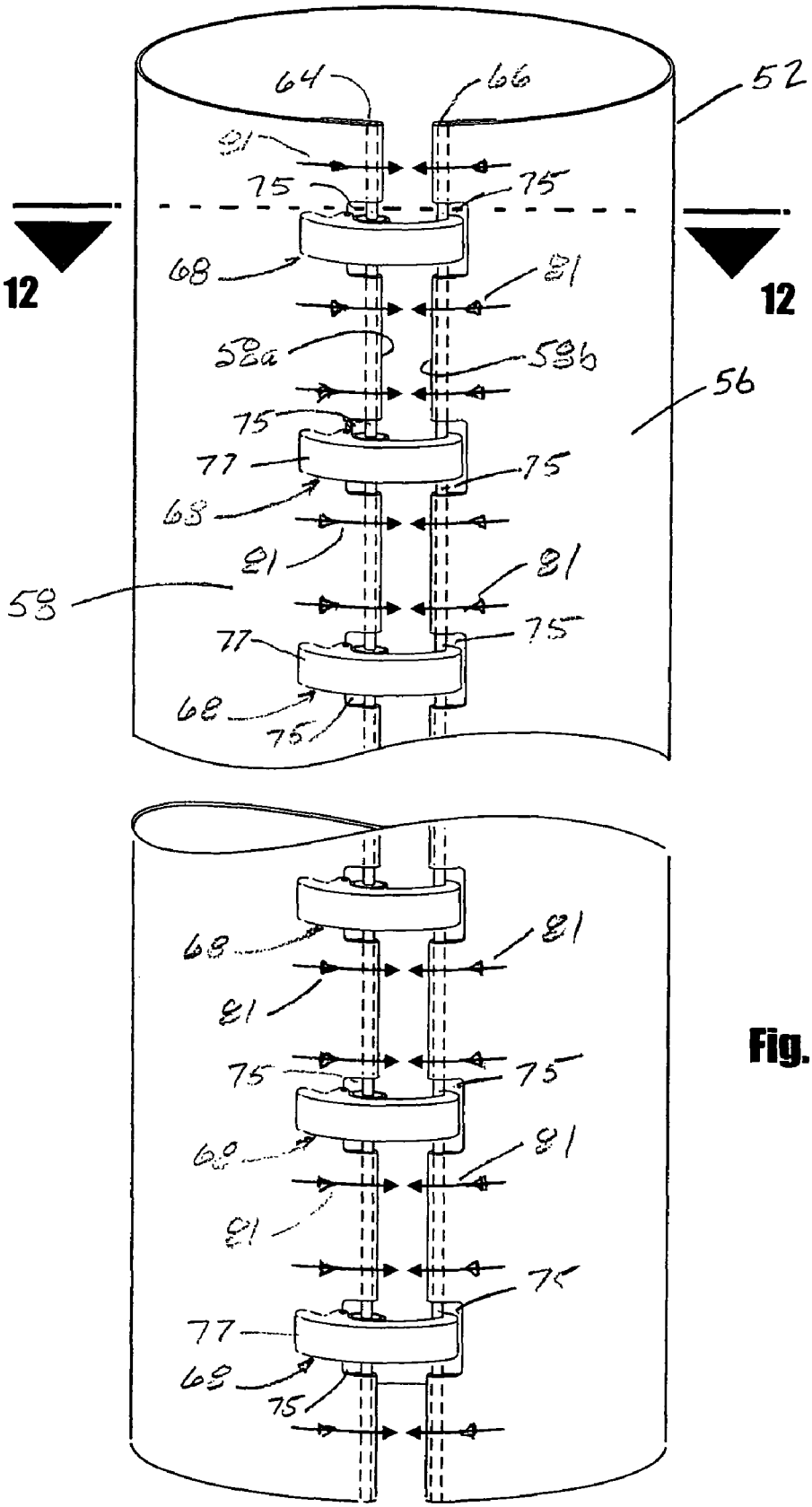
FIG. 11 is a generally perspective, foreshortened view of an alternate form of the securement component of another embodiment of the concrete forming system of the invention.
Figure 12:
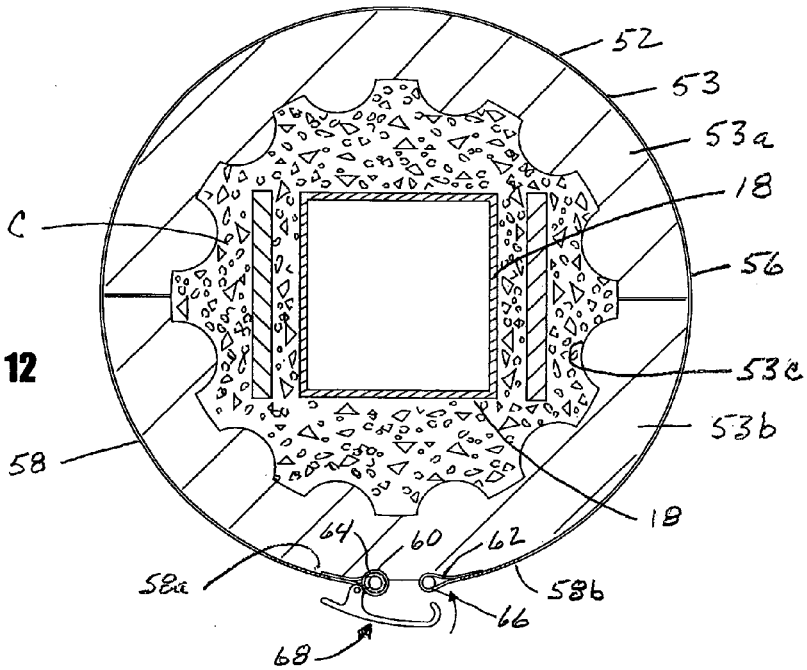
FIG. 12 is an enlarged cross-sectional view taken along lines 12-12 of FIG. 11.
Figure 12A:
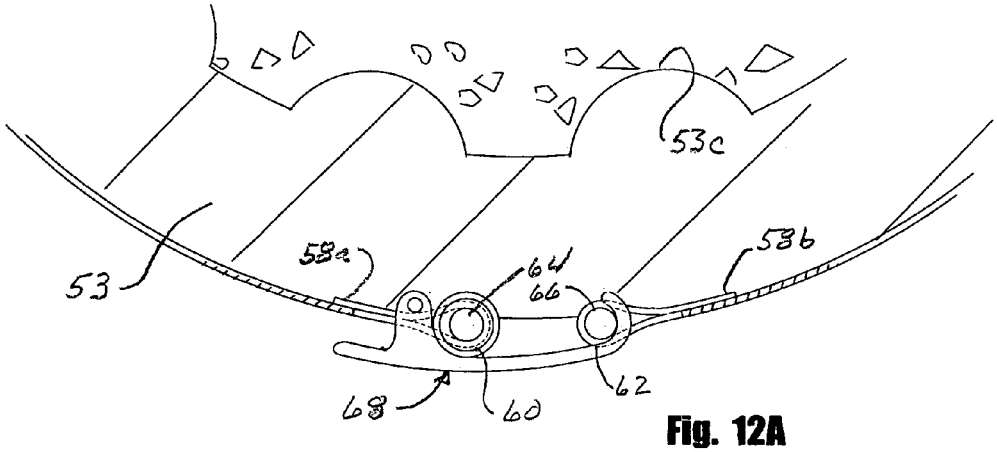
FIG. 12A is an enlarged, fragmentary cross-sectional view of the draw latch area of FIG. 12, but showing the draw latch connector member moved into a closed position to draw the spaced apart draw tube closer so as to positively pre-load the Styrofoam shape component of the apparatus of the invention prior to pouring concrete.

Referring now to FIGS. 11 through 12A, the various components of an alternate form of the apparatus of the invention for constructing a concrete column are there shown. This latest embodiment of the invention is similar in many respects to that illustrated in FIGS. 1 through 10 of the drawings and like numerals are used in FIGS. 11 through 12A to identify like components. As in the earlier described embodiments, an important and quite unique component of this latest form of the apparatus is the novel securement component 52 the character of which is shown in FIG. 11 of the drawings. As in the earlier described embodiment of the invention, this important component encircles the elongate Styrofoam assembly 53 of the invention (FIG. 12). Assembly 53, which comprises two halves 53*a* and 53*b*, is substantially identical in construction and operation to the elongate Styrofoam assembly previously described and is provided with a concrete receiving chamber 53*c* that is here shown as being generally fluted in cross-section. Centrally disposed within the concrete receiving chamber is an elongate metal reinforcing member 18 that is also substantially identical in construction and operation to that previously described. It is to be understood that the concrete receiving chamber 53*c* can be of various configurations including being generally rectangular in cross-section, being generally circular in cross-section and being generally octagonal in cross-section.

As indicated in FIG. 11 of the drawings, securement component 52 here comprises a reusable, flexible securement jacket 56 that includes a body portion 58 having spaced apart lateral edges 58*a* and 58*b*. As best seen in FIGS. 12 and 12A, lateral edges 58*a* and 58*b* cooperate with body portion 58 to form longitudinally extending draw tube receiving connector segments 60 and 62 that each telescopically receives an elongated, tubular shaped draw tube. More particularly, connector segment 60 telescopically receives a first elongated draw tube 64, while connector segment 62 telescopically receives a second elongated draw tube 66 (FIG. 12A).

Securement jacket 52 can be constructed from various durable materials, such as a polyvinylchloride coated, high tenacity polyester and like polymer materials. Assembly 53, can also be constructed from various materials, but preferably is constructed from a rigid, lightweight foam material such as Styrofoam.

Securement jacket 52 also includes novel connector means for releasably connecting together the lateral edges of the securement jacket so as to secure the securement jacket in position about the elongate assembly 53 in the manner shown in FIG. 12 of the drawings.

As best seen in FIGS. 11 through 12A, the connector means of this latest form of the invention comprises a plurality of longitudinally spaced-apart adjustable draw latches 68 that function to releasably interconnect the draw tubes 64 and 66.

Turning particularly to FIGS. 11A, 11B, 11C and 11D it can be seen that each of the adjustable draw latches 68 comprises a hub portion 70 that is rotatably connected to the first draw tube 64, an elongated body portion 72 that is pivotally connected to the leg 70*a* of the hub portion and a curved latch portion 74 that is engagable with the second draw tube 66. As indicated in FIGS. 11, 11B, 11C and 11D, the lateral edges of the securement jacket are provided with spaced apart openings 75 to accommodate the plurality of longitudinally spaced-apart adjustable draw latches 68.

Figures 11A, 11B, 11C, 11D:
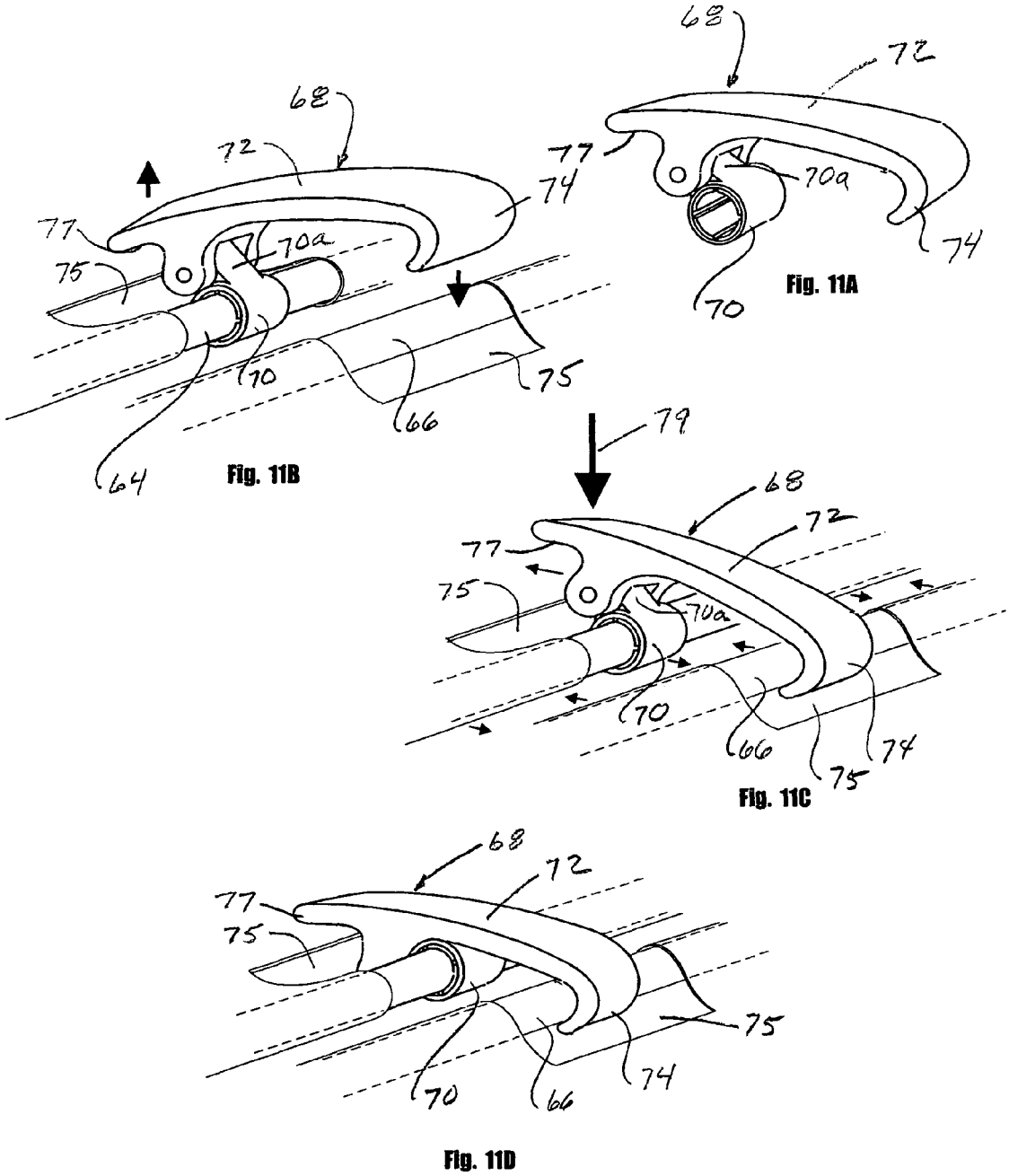
FIG. 11A is a generally perspective view of one form of the draw latch connector member of the present invention.
FIG. 11B is a generally perspective illustrative view showing the draw latch connector member interconnected with one of the draw tubes of the securement jacket assembly of the apparatus of the invention.
FIG. 11C is a generally perspective illustrative view similar to FIG. 11B, but showing the draw latch connector member moved into engagement with the other of the draw tubes of the securement jacket assembly of the apparatus of the invention.
FIG. 11D a generally perspective illustrative view similar to FIG. 11C, but showing the draw latch connector member moved into a closed position to draw the other of the draw tubes closer so as to positively pre-load the Styrofoam shape component of the apparatus of the invention prior to pouring concrete.

As illustrated in FIGS. 11B and 11C, by lifting on the finger engaging portion 77 of the draw latch, the hub portion 70 will be caused to rotate relative to the first draw tube 64 from the first position shown in FIG. 11B, wherein the latch portion 74 is spaced apart from second draw tube 66, to the second position shown in FIG. 11C wherein the latch portion 74 has moved into engagement with draw tube 66. From the second position shown in FIG. 11C, by pressing downwardly on the finger engaging portion 77 of the draw latch as indicated by the arrow 79, hub portion 70 will be caused to rotate relative to hub portion 70 toward the third position shown in FIG. 11D wherein the draw latch has acted upon the draw tubes in a manner to urge them to draw closer together.

As indicated by the arrows 81 in FIG. 11, as the draw latches act upon the draw tubes to urge them to draw closer together, a uniform load is placed upon the body portion 58 of the securement jacket, which, in turn, uniformly pre-loads the elongate Styrofoam assembly 53. Due to the novel construction and positioning of the draw tubes, the load imposed on the securement jacket is uniquely distributed evenly throughout the entire surface of the jacket material. Additionally, draw tubes 64 and 66 serve to help lift and position the jacket material smoothly and evenly around the elongate Styrofoam assembly 53 until the draw-latches can be engaged.

Considering now the form of the method of the invention for constructing a vertically extending concrete column using the novel flexible securement jacket 52. First the two halves of the elongate assembly 53 are joined together and disposed in a generally vertical orientation. This done, the securement jacket 52 is wrapped around the assembly 53 in the manner illustrated in FIG. 12. With the securement jacket in position around the Styrofoam assembly, the adjustable draw latches 68 are operated in the manner previously described to draw together the draw tubes of the securement jacket in the manner illustrated in FIGS. 11D and 12A of the drawings. With the elongate assembly 53 thusly preloaded, the concrete "C" is poured into the concrete receiving chamber 53*c* (FIG. 12), and the flexible securement jacket is maintained in position about the assembly 53 for a period of time sufficient to allow the concrete to set-up to form a hardened concrete column.

Once the concrete has set up, the latches 68 are manipulated so that the securement jacket can be removed from its position about the assembly 53. Once removed, the securement jacket can be rolled into a compact roll for transport and storage pending its next use. With the securement jacket removed from about the assembly 53, the two halves of the assembly can be separated from the concrete column and appropriately relocated or stored for subsequent use.

In another form of the method of the invention for replacing a wooden post disposed between a supporting base and an overhead structure with a concrete column, the first step comprises removing the wooden post. Next, a structural support is positioned between the supporting base and the overhead structure. This done, a metal reinforcing member is positioned between the supporting base and the overhead structure. Next, the elongated assembly 53 is positioned around the metal reinforcing member in a manner such that said metal reinforcing member is disposed generally centrally of the concrete receiving chamber 53*c*. With the elongated assembly 53 thusly in position, the flexible securement jacket 52 is placed around the elongate assembly and the draw latches are operated to draw together the draw tubes. This action will cause the securement jacket 52 to uniformly compress the assembly 53 in a manner to substantially prevent expansion of the assembly upon pouring concrete into the concrete receiving chamber 53*c*.

With the securement jacket 52 thusly in position, the concrete is poured into the concrete receiving chamber 53 and the flexible securement jacket is maintained in position about the assembly 53 for a period of time sufficient to allow the concrete to set-up to form a hardened concrete column. Finally, the flexible securement jacket is removed from about the assembly 53 and the assembly 53 is removed from about the hardened concrete column.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

The invention claimed is:

1. An apparatus for constructing a concrete column comprising:

(a) an elongated assembly having a concrete receiving chamber;

(b) a reusable, flexible securement jacket for circumscribing said elongated assembly, said flexible securement jacket having:

(i) a first lateral edge having a connector segment; and (ii) a second lateral edge having a connector segment;

(c) a first elongated draw tube telescopically received within said connector segment of said first lateral edge of said securement jacket;

(d) a second elongated draw tube telescopically received within said connector segment of said second lateral edge of said securement jacket; and (e) connector means for interconnecting said first and second elongated draw tubes to secure said securement jacket in position about said elongate assembly, said connector means comprising a plurality of longitudinally spaced-apart, adjustable draw latches inter-connecting said first and second elongated draw tubes.

2. The apparatus as defined in claim 1 in which said concrete receiving chamber is generally rectangular in cross section.

3. The apparatus as defined in claim 1 in which said concrete receiving chamber is generally circular in cross section.

4. The apparatus as defined in claim 1 in which said concrete receiving chamber is generally octagonal in cross section.

5. The apparatus as defined in claim 1 in which said concrete receiving chamber is generally fluted in cross section.

6. The apparatus as defined in claim 1 in which each of said plurality of adjustable draw latches comprises a hub portion rotatably connected to said first draw tube, an elongated body portion pivotally connected to said hub portion and a latch portion engagable with said second draw tube.

7. The apparatus as defined in claim 6 in which said hub portion of each of said draw latches is rotatable relative to said first draw tube from a first position wherein said latch portion of each of said draw latches is in a first position and in which said hub portion of each of said draw latches is rotatable relative to said first draw tube to a second position to cause said latch portion of each of said draw latches move toward a second position to urge said first and second draw tubes to draw together.

8. An apparatus for constructing a concrete column comprising:

(a) an elongated assembly constructed from a lightweight foam material, said elongate assembly having a concrete receiving chamber and comprising first and second cooperating portions;

(b) a reusable, flexible securement jacket for circumscribing said elongate assembly, said flexible securement jacket having:

(i) a first lateral edge having a connector segment; and (ii) a second lateral edge having a connector segment;

(c) a first elongated draw tube telescopically received within said connector segment of said first lateral edge of said securement jacket;

(d) a second elongated draw tube telescopically received within said connector segment of said second lateral edge of said securement jacket; and (e) connector means for interconnecting said first and second elongated draw tubes to secure said securement jacket in position about said elongate assembly, said connector means comprising a plurality of longitudinally spaced-apart, adjustable draw latches inter-connecting said first and second elongated draw tubes, each of said plurality of adjustable draw latches comprising a hub portion rotatably connected to said first draw tube, an elongated body portion pivotally connected to said hub portion and a latch portion engagable with said second draw tube.

9. The apparatus as defined in claim 8 in which said hub portion of each of said draw latches is rotatable relative to said first draw tube from a first position wherein said latch portion of each of said draw latches is in a first position and in which said hub portion of each of said draw latches is rotatable relative to said first draw tube to a second position to cause said latch portion of each of said draw latches to move toward a second position to urge said first and second draw tubes to draw together.

10. An apparatus for constructing a concrete column comprising:

(a) an elongated assembly having a concrete receiving chamber;

(b) a reusable, flexible securement jacket for circumscribing said elongated assembly, said flexible securement jacket having first and second lateral edges;

(c) a first elongated draw tube connected to said first lateral edge of said securement jacket;

(d) a second elongated draw tube connected to said second lateral edge of said securement jacket; and (e) connector means for interconnecting said first and second elongated draw tubes to secure said securement jacket in position about said elongate assembly, said connector means comprising a plurality of longitudinally spaced-apart, adjustable draw latches inter-connecting said first and second elongated draw tubes.

* * * * *